United States Patent [19]

Galati

[11] Patent Number: 4,811,908

[45] Date of Patent: Mar. 14, 1989

[54] METHOD OF FIBRILLATING FIBERS

[75] Inventor: Celeste C. Galati, Johnsonburg, Pa.

[73] Assignee: Motion Control Industries, Inc., Ridgway, Pa.

[21] Appl. No.: 133,560

[22] Filed: Dec. 16, 1987

[51] Int. Cl.[4] ..... B02C 19/12

[52] U.S. Cl. ..... 241/21; 162/9; 162/100; 241/24

[58] Field of Search ..... 264/140; 162/9, 100, 162/187; 241/4, 5, 21, 282.1, 282.2, 24; 57/2; 19/0.35

[56] References Cited

U.S. PATENT DOCUMENTS

| | | | |
|---|---|---|---|
| 3,068,527 | 12/1962 | Morgan . | |
| 3,242,035 | 3/1966 | White . | |
| 4,150,011 | 4/1979 | Searfoss et al. . | |
| 4,374,211 | 2/1983 | Gallagher et al. . | |
| 4,374,702 | 2/1983 | Turbak et al. | 241/5 X |
| 4,477,526 | 10/1984 | Lauterback . | |
| 4,501,047 | 2/1985 | Wrassman . | |

OTHER PUBLICATIONS

"5-2 Beating and Refining Equipment", by Donald W. Danforth of Bolton—Emerson, Inc.

"ISO Standards Handbook 23—Paper Board and Pulps", 1984.

American Cyanamid Company "Creslan The Creative Fiber", Technical Fact Sheet on Fiber Properties of Type 98 Cyanamid Acrylic Fiber.

*Primary Examiner*—Mark Rosenbaum

*Attorney, Agent, or Firm*—Wood, Herron & Evans

[57] ABSTRACT

A method of mechanically converting unbranched fibers into highly branched or "fibrillated" fibers which are especially suitable for reinforcing composite materials such as brake linings. Unbranched starting fibers, immersed in water, are subjected to prolonged working in an intensive mixer or chopper having a very rapidly spinning blade with sharp knife edges, until extensive fiber branching occurs. Fibrillation can be achieved by this method even though conventional fiber "refining" techniques have no significant effect on the same starting material.

17 Claims, 4 Drawing Sheets

METHOD OF FIBRILLATING FIBERS

FIELD OF THE INVENTION

This invention relates to the preparation of reinforcing fibers, and more particularly to a mechanical method of converting a relatively inexpensive monofilament or unbranched form of fiber into a form having a high degree of fibrillation, so that the fiber becomes suitable for use as a reinforcing material for composite mixtures.

BACKGROUND

In the production of composite materials, for example friction materials for use as brake linings, clutch faces, and the like, fibrous materials are used to bind the composition together. The reinforcing fibers not only impart desirable characteristics to the final product, they also provide "green strength" during preforming of the composite wherein the composition mixture is preliminarily compacted or densified prior to final pressing and curing. (Pre-forming of compositions for friction materials is well known in the art, see for example Searfoss et al U.S. Pat. No. 4,150,011 and Gallagher et al U.S. Pat. No. 4,374,211, to which reference may be had for further background.)

For many years asbestos appeared to be the ideal reinforcing material for composite friction materials. It is inexpensive, extremely durable, and its fiber bundles can easily be "opened" to provide a fiber mass which displays a large surface area per unit weight. This in turn provides strong engagement with and binding of frictional compositions.

However, the controversy concerning the possible carcinogenic effect of asbestos prompted attempts to develop alternative materials. This has proven very difficult in practice. Many substitute materials have been suggested and tried, but very few of them have proven satisfactory in commercial practice. Two principal reasons for the lack of success have been the fact that other fibers have not, with few exceptions, provided anywhere near the preformability and reinforcing properties of asbestos fibers; and those which do are undesirably expensive. For example, the aramid synthetic fibers, such as those sold by DuPont under the trademark "Kevlar", are available in a so-called "pulp" form which has a high degree of fibrillation, but its high cost has hindered widespread use. On the other hand, fibers such as acrylic, nylon, fiberglass, wollastonite, steel, mineral fibers, ceramic fibers, cotton and polyester, are less expensive than Kevlar, but it has not been possible to provide them in forms with sufficient degrees of fibrillation to reinforce as effectively as Kevlar.

There has thus been a strong demand for a lower cost fiber which can be fibrillated to a degree equivalent to that of Kevlar pulp fiber. Extensive research programs have been undertaken to develop such an alternative, but so far without commercial utility and practicality.

PRIOR ART

American Cyanamid Company of Wayne, N.J. has advertised that its "Creslan T-98" brand acrylic fiber (a co-polymer of acrylonitrile and methyl methacrylate) can be refined to "split" the fibers longitudinally and form fibrils along the main filament, similar to cellulose, asbestos and Kevlar. However, so far as is known to me, all attempts to refine this acrylic material to fibrillate it have demonstrated that the resulting material is not sufficiently opened or fibrillated to serve satisfactorily as a reinforcing material in composite friction material.

Morgan U.S. Pat. No. 3,068,527, assigned to DuPont, teaches a process of producing a fibrid slurry in which a polymer gel structure produced by an interfacial technique is violently agitated by a "Waring Blendor" or similar device. The interface polymerization is conducted between fast reacting organic condensation polymer-forming intermediates at an interface of controlled shape between two liquid faces. The gel, prior to drying, is torn or shredded by the blender and forms a fibrous slurry. The patent teaches that the gel structure is destroyed on drying of the interfacially formed structure, and that thereafter the final or formed structure will not form fibrils when beaten in the liquid suspension.

White U.S. Pat. No. 3,242,035, assigned to DuPont, teaches a method wherein polyamide and other materials are fibrillated by passing a film-like strip of material through a zone of high turbulence provided by a high velocity jet of air. The turbulence ruptures the film to form a multifibrous continuous network of fibrils.

Lauterbach U.S. Pat. No. 4,477,526, also assigned to DuPont, teaches a method wherein continuous filament aromatic polyamide yarns are stretch-broken under high tension while being sharply deflected in a lateral direction by a mechanical means. The broken ends of the fibers are highly fibrillated, to provide a brush-like appearance at the end of the fiber.

Wrassman U.S. Pat. No. 4,501,047 discloses a process in which agglomerates of Kevlar and other fibers are separated into discrete fibers by resilient contact with a series of blades which have pick-like or pointed tips. The process is performed in a continuous airstream that carries the separated fibers to an outlet.

So-called "refiners" are well known for treating fibers to give them some of the properties needed for the manufacture of pulp or paper. In these devices, the fibers or particles are suspended in water and subjected to a shearing or cutting action under pressure, usually between a cone and plug or between disks. Refining is usually a continuous operation; a beater, which is a machine fitted with a bed-plate and a roll, is usually used for batch operations. By way of example, such devices are produced by Bolton-Emerson Inc. of Lawrence, Mass., and Beloit Corp. of Pittsfield, Mass.

"Beating and Refining-Equipment", an article by Donald W. Danforth of Bolton-Emerson, Inc., contains a summary of techniques and equipment for treating fibers for the manufacture of paper and paperboard.

"ISO Standards Handbook 23 - Paper Board and Pulps", 1984, briefly describes "refiners" and "beaters" for the treatment of fibrous materials.

Unsuccessful Efforts to Fibrillate Staple Fibers

The initial attempts to use a commercially available acrylic staple fiber made by BASF were unsuccessful inasmuch as preforms could not be produced; the preformed composite was not sufficiently durable to enable it to be transferred from the preforming mold to the mold wherein final pressing is carried out. Efforts to overcome this problem by crimping and dry grinding in an attrition mill were unsuccessful. A minor degree of fibrillation was eventually achieved, but it was inadequate for preforming friction materials.

The previously-identified Creslan T-98 acrylic fiber produced by American Cyanamid contains included water which presumably would make it easier to fibrillate. I approached several commercial refiner manufacturers with a view to fibrillating this material, in the hope that it might be refined in a manner similar to paper making fibers. Attempts were made to fibrillate it in several different types of refiners and beaters, including commercial refining machines made by Beloit and Bolton-Emerson, already identified.

The comparative degree of fibrillation achieved by a specific process can be effectively observed by examining the fibers under magnification of 100x or more, with a scanning electron microscope. Some fibers which appear to be fibrillated when examined by the unaided eye, can be seen under such magnification to be only poorly fibrillated or even degraded. (As used herein "fibrillated" means that much smaller diameter branches or fibrils are split longitudinally from the main larger diameter stem or trunk; the fibrils are long and tangled but most remain attached to the trunk at one end.) A more pragmatic test of the degree of fibrillation is to incorporate the fiber in a friction composite and observe the degree of green strength it imparts to a pre-form.

As shown hereinafter, no useful fibrillation could be achieved for many materials, and even the preferred form of fibers used in this invention could not be effectively fibrillated in commercial refiners, but only by the new method I have discovered.

BRIEF DESCRIPTION OF THE INVENTION

In accordance with this invention, filamentary fibers having no or only a low degree of fibrillation are converted into a fibrillated, highly branched fibers which have a physical structure similar to Kevlar pulp, by exposing the formed (as opposed to newly reacted or gel-state) unfibrillated fiber to intensive agitation by sharp edged spinning blades, while suspended in a liquid, such as water, to which the fibers are inert. The blades can be mixing or chopping blades and establish a vortex with turbulent flow such that the suspension repeatedly passes across the individual blades so that the long sharp knife edges of the blades hit the fibers. The fiber mass is thereafter separated from the liquid and dried.

Especially good results are obtained if the starting fiber is an acrylic fiber which is a copolymer of acrylonitrile and methyl methacrylate, having an entrained water content of about 50%, such as the "Creslan T-98" fiber. On a bench scale, fibrillation can be accomplished by using a chopper/mixer of the type sold by Osterizer Division of Sunbeam Corp., Milwaukee, Wis. under the "Osterizer" trademark (cf. their U.S. Pat. No. 2,530,455). Other useful small scale size mixers/choppers are made by Waring Products Division of Dynamics Corporation of America, New Hartford, Conn., and by General Electric.

It is important to point out that exposing the fiber to the action of such blades in air does not achieve a degree of fibrillation which is useful for reinforcing composite materials; the fiber must be suspended in liquid and turbulently recirculated across the blades for effective results. Moreover, even under liquid immersion, an unusually long time may be required. For example, a conventional household "Osterizer" requires about 20 minutes at high speed to fibrillate about 2 grams of acrylic fiber, even at the highest speed setting ("liquify").

DESCRIPTION OF THE DRAWINGS

The invention can best be further explained and described by reference to the accompanying drawings, in which.

Figure 1:
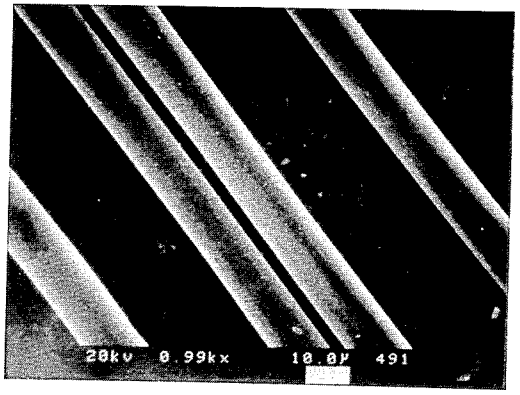
FIGS. 1–8 and 10–13 are scanning electron microscope photographs of various types of fibers, as purchased or after processing in various devices. The actual magnification of each picture can be calculated from the printed dimension in microns (μm) which corresponds to the width of the rectangle printed within the border of the photograph.
Figure 2:
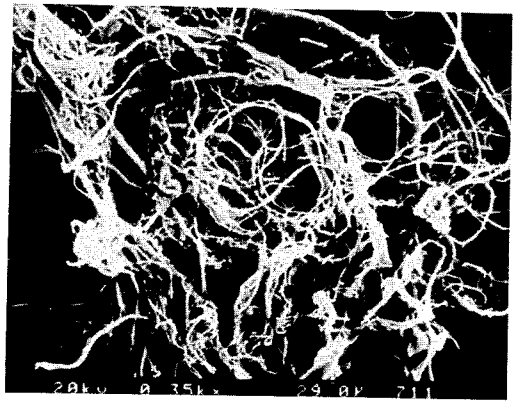
Figure 3:
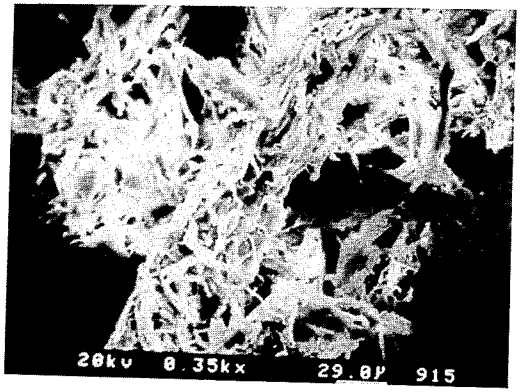
Figure 4:
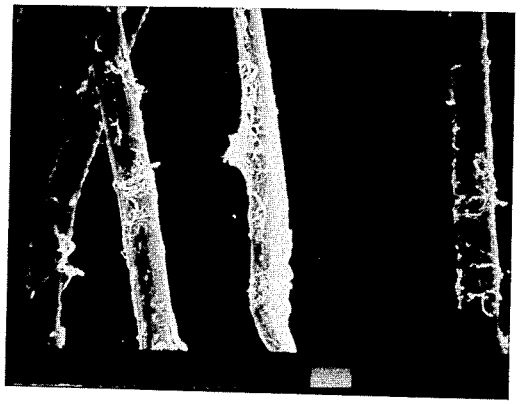
Figure 6:
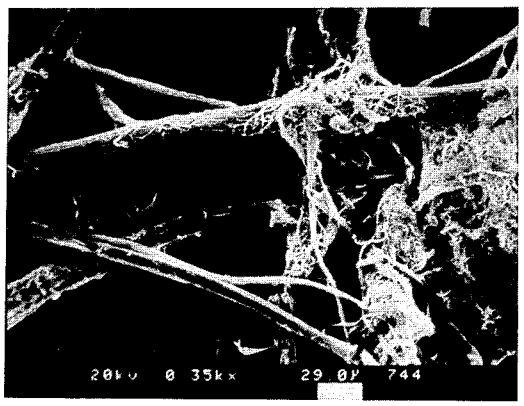
Figure 5:
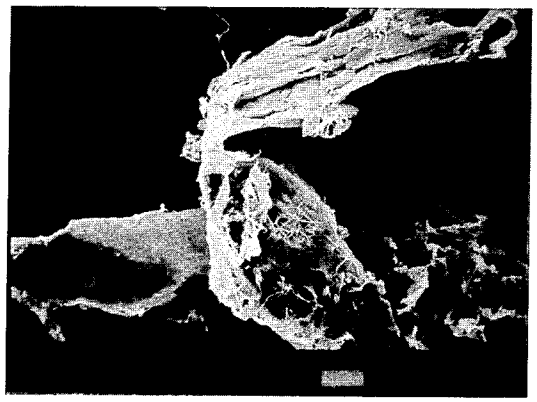
Figure 8:
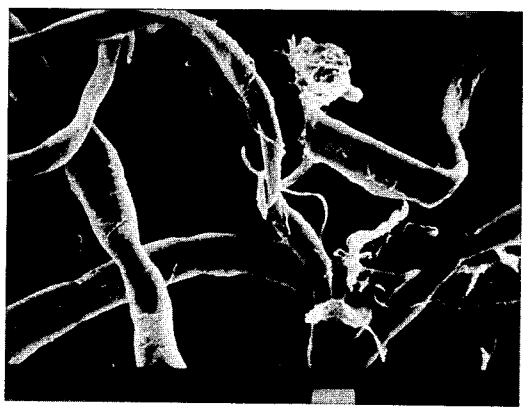
Figure 7:
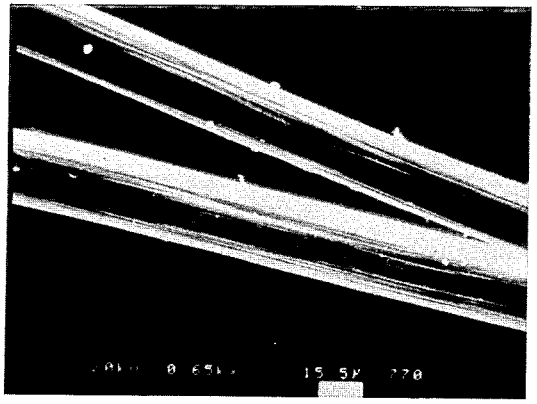
Figure 9:
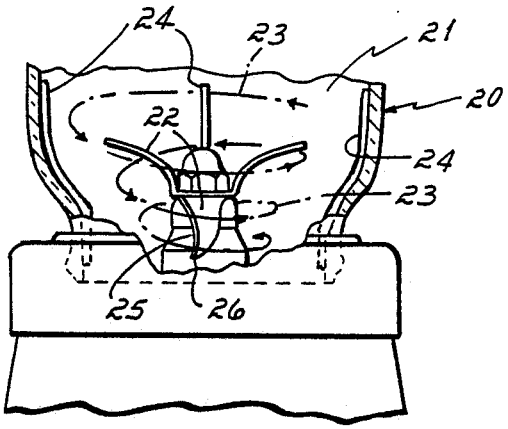
Figure 10:
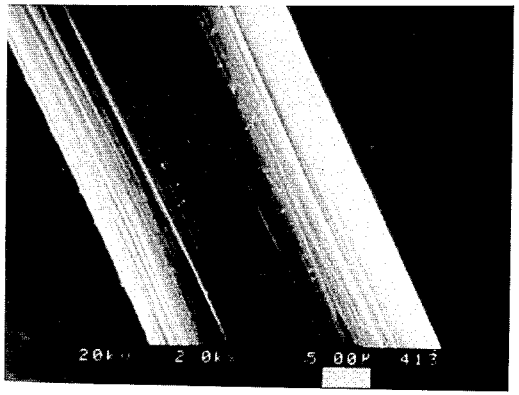
Figure 11:
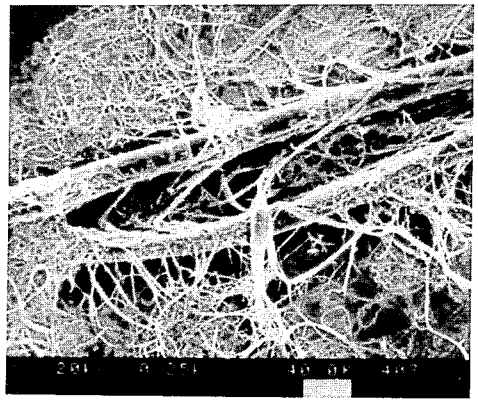
Figure 12:
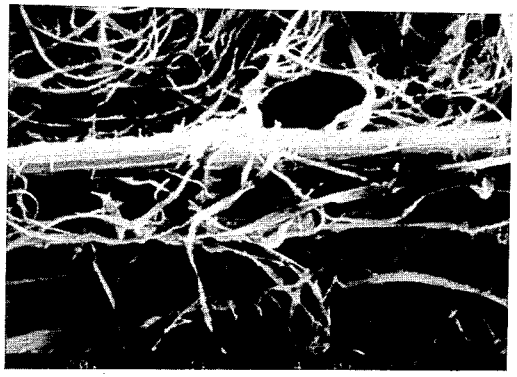
Figure 13:
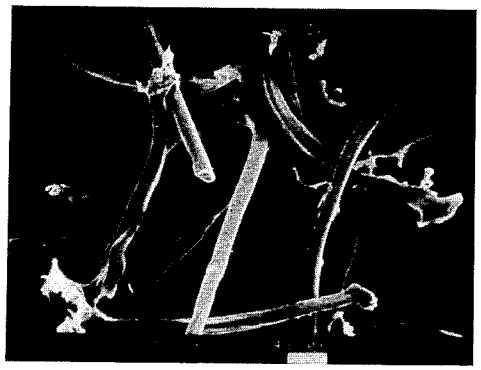

Specifically,

FIG. 1 shows commercial Kevlar staple (unfibrillated) fiber;

FIG. 2 shows commercial Kevlar pulp fiber,

FIG. 3 shows the unsatisfactory mass obtained by treating Creslan T-98 type of acrylic fiber in a Beloit "high consistency" commercial refiner;

FIG. 4 shows the unsatisfactory results when the same type of fiber is processed in a Bolton-Emerson tornado type of commercial pulper;

FIG. 5 shows the unsatisfactory results obtained when the same type of acrylic fiber is processed in a Clafflin-type refiner;

FIG. 6 shows the same type of fiber as processed by American Cyanamid to improve its fibrillation;

FIG. 7 shows the lack of fibrillation of the same type of fiber after treatment in accordance with Wrassman U.S. Pat. No. 4,501,047;

FIG. 8 shows "A513" brand acrylic fibers as processed by BASF;

FIG. 9 is a diagrammatic illustration of apparatus for use in the preferred method of carrying out the invention on a small scale;

FIG. 10 shows commercial Creslan T-98 brand acrylic staple fibers, before processing;

FIG. 11 shows Creslan T-98 acrylic fiber after processing in accordance with the preferred method of practicing the invention, and illustrates the high degree of fibrillation thereby achieved;

FIG. 12 shows Kevlar staple fiber which has been processed in accordance with the invention and illustrates the high degree of fibrillation achieved; and FIG. 13 shows nylon flock fiber processed in an Osterizer mixer-blender and illustrates the unsatisfactory fibrillation achieved.

DETAILED DESCRIPTION

The difference between unfibrillated and highly fibrillated forms of the same basic polymer ("Kevlar" brand aramid) is apparent from comparison of FIGS. 1 and 2. So-called Kevlar "staple", shown in FIG. 1, is essentially monofilamentary and unbranched; the fibers are essentially parallel, unentangled, and have no fibrils branching from them. Fiber surface area is relatively low per unit weight. This fiber imparts little green strength to a preform of a composite friction material, and is unsatisfactory in pre-forming. In contrast, FIG. 2 shows the so-called "pulp" form of Kevlar (sold commercially by DuPont), which is very highly fibrillated and has tangled fibrils that generally remain attached at their ends to the larger trunk fibers. This form has a large surface area for its weight, and is highly suitable for use in reinforcing friction materials.

It was the object of this invention to develop a method whereby a staple form of starting material, less expensive than Kevlar, could be converted into a new form having a degree of fiberosity approaching that displayed by Kevlar pulp.

Attempts of previously identified refiner manufacturers to do this were carried out with acrylic fibers at my request, and were entirely unsuccessful. Electron microscope examination of Creslan T-98 acrylic staple as supplied shows that the fibers are unbranched (FIG. 10). When the material was processed in prior art refiners and beaters of several different types, the results were not nearly as good as the Kevlar pulp shown in FIG. 2. Prior to the discovery of the present method, no processing technique was found which achieved fiber characteristics like those of Kevlar, that is, long, thin, tangled, excelsior-like fibrils which remain attached to the trunk or stem fibers of diameter several times larger. For example, type T-98 acrylic fiber processed in a commercial "high consistency" refiner made by Beloit produced a rather coarse, dense, degraded form (FIG. 3) including pieces which appear to have been melted or fused. This material is unacceptable for use as a reinforcing agent in friction material. This is demonstrated by attempting to preform mixes using fiber processed by the above method; the results are unsatisfactory.

Again, when the same acrylic staple material was processed in a so-called "tornado" pulper, produced by Bolton-Emerson Company, the fibers merely kink or deform (FIG. 4); the fiber shows little more fibrillation than that of the staple starting material.

Still further, when the same starting material is processed in a Bolton-Emerson Clafflin-type refiner, the fibers were degraded with little formation of fibrils (FIG. 5).

Samples of Creslan T-98 supplied by American Cyanamid, double passed through a disc refiner, showed little fibrillation and even supposedly "fibrillated" material (FIG. 6) sampled by American Cyanamid, made later by them by an undisclosed method, displayed poor fiber characteristics. That material comprised matted felt-like masses of very fine fibers, largely disconnected from the trunk fibers. These unattached mats do not adequately "anchor" or tie together a composite.

Attempts to fibrillate this same type of acrylic fiber with other types of refiners, including valley beaters and Koller mills, all yielded an insufficient amount and type of fibrillation.

Nor did processing the acrylic fiber in a device of the type described in Wrassman U.S. Pat. No. 4,501,047, previously referred to, fibrillate it. As shown in FIG. 7, the staple fibers showed only a few fibrils, and they were short and fine. The material was "opened" as the patent indicates, but not fibrillated and was inadequate for preforming.

The result of an attempt by BASF to fibrillate its A513 brand of acrylic fiber is shown in FIG. 8. Again, the fibrillation is inadequate.

I therefore concluded that acrylic fiber cannot be pulped in available refiners, beaters, or other equipment representing the state of art for paper pulp manufacture.

Somewhat in desperation after a long series of fruitless attempts to fibrillate with commercial refiners and beaters, I finally made a test with a domestic "Osterizer" brand mixer/chopper which I had at my home. To my surprise, I discovered that acrylic fiber containing included water could be fibrillated to a very satisfactory degree, if immersed in liquid in this type of machine. This machine is, of course, a chopping, mixing and blending device, and its effect in fibrillating was therefore surprising, especially considering that commercial refiners were ineffective.

The objective of imparting a high degree of branching to monofilamentary or unbranched fibers would not seem to be served by working the fiber in a chopping or mixing type of device, which has knife-like cutting blades. Such a device would be expected to chop fibers transversely into shorter lengths, rather than to fibrillate them. Indeed, a chopping type of effect—i.e., cutting the fibers into shorter lengths—is all that results when nylon fiber is processed in a chopping type of device. The processed nylon fibers, shown in FIG. 13, were not fibrillated.

The best material for use in this method is acrylic fiber which contains 50% included water. (By "included water" is meant elongated pockets of water entrapped within the fiber itself, not merely surface wetness). Experimentation to date has shown that if a dry form of the fiber is used (a dry form is available, or the water can be removed by heating), the fibers do not adequately fibrillate under the present method. It is theorized that the water inclusions may establish longitudinally extending "zones of weakness", along which the fiber tends to split.

The preferred form of starting material, Creslan T-98 having a denier of 5.4, is shown enlarged in FIG. 10, and can visually be likened to the unbranched monofilamentary Kevlar staple shown in FIG. 1. The material is converted to a highly fibrillated form as shown in FIG. 11, by processing in accordance with the invention.

FIG. 9 shows the internal configuration of an "Osterizer" mixer-chopper which is presently preferred for carrying out the process on a small scale. This device has a vessel 20 presenting a processing chamber 21 of truncated conical shape. Four blades 22 extend at right angles to one another and are alternately curved up or down. Baffles in the form of ribs 24 are formed on the vessel wall, and project inwardly toward the paths of movement of the blades. This configuration creates a strong turbulent vortex action (designated by the arrows 23) whereby essentially all the fibers in the suspension are recirculated across the paths of movement of the blades. Each blade has a sharp cutting edge 25; this has been found to be important in contributing to fibrillation, because a blade having a dull edge, or merely a sharp tip, is ineffective. The lower blade tips project outwardly about 90% of the distance to the vessel wall, so that the clearance is only about 10% of the radius of the blades. The fibers are thereby closely confined and cannot escape passing downwardly between the blades as they are recirculated by the turbulent vortex action.

In the preferred practice of the method, as used to produce the fibers shown in FIG. 11, 750 ccs. water were placed into a 1.25 liter vessel. 2 grams of staple T-98, denier 5.4, fiber were suspended at a low blade speed setting and then agitated at the highest speed setting ("liquify") for 20 minutes. The blade speed (no load) at the highest speed setting is believed to be roughly 100 feet per second at blade tips 26.

It can be seen that some large stem or trunk fibers remain in the product shown in FIG. 11; possibly they might be further fibrillated by continued working, but the fibrillation shown is excellent. There is a surprising lack of fines and degraded or separated fibril bits; by and large the fibers form an entangled mass, not a collection of discrete pieces, and remain strongly attached to the large or stem fibers.

The similarity between the morphological properties of the fibrillated T-98 and Kevlar pulp was demonstrated by separately incorporating the fibers into standard composite test mixtures. Comparison of both the green strengths and cured product performances were made. The test mixture used was of the type shown in the Searfoss patent previously identified; separate batches containing 3.3% wt. of each fiber specified below were made. Mixing procedure was uniform for each batch. A preform of 100 g was made from each of the three batches, using a three bump cycle of 500 psi. Initial readings of hardness (durometer) and thickness were taken; two additional readings were taken over a 48 hour period.

Results:

| Fiber | | Durometer Values | Thickness |
|---|---|---|---|
| A. Kevlar Pulp | Initial | 83,85,85,86 | 16–17 mm |
| | 24 hours | 84,82,79,83 | 16–19 mm |
| | 48 hours | 75,77,78,82 | 17–20 mm |
| B. T98 fibrillated in accordance with invention | Initial | 80,85,85,87,80 | 16–17 mm |
| | 24 hours | 83,80,80,79 | 17–20 mm |
| | 48 hours | 76,80,75,73 | 17–20 mm |
| C. T98 Acrylic staple | Initial | 68,70,74,75 | 20–25 mm |
| | 24 hours | 60,74,72,66 | 20–27 mm |
| | 48 hours | Unstable | 22–28 mm |

The visually perceived integrity of the preform containing fibrillated T98 (Batch B) corresponded to that of the preform containing Kevlar pulp (Batch A). In contrast, an unacceptable degree of integrity resulted from the preform made with Batch C having the acrylic staple constituent. This infirm preform was also characterized by the lack of definite edges.

The test samples made from Kevlar pulp and fibrillated T98 were cured and then tested for impact resistance and frictional properties. Impact resistance was measured by a Dynatup drop weight impactor system manufactured by General Research Corp. Testing parameters of a 10.01 lb. hammer weight and a Charpy tup raised to a height of 1 inch were employed. Each of the cured pieces was subjected to the test five times.

Results:

| Fiber | Max. Load (lbs.) |
|---|---|
| Kevlar Pulp | 718, 723, 748, 738, 734 |
| Fibrillated T98 | 739, 722, 724, 725, 717 |

Utilizing the SAE J661a procedure, the friction ratings of the materials were determined:

| Fiber | Friction Rating | % Wear |
|---|---|---|
| Kevlar Pulp | N–.40 (F) H–.37 (F) | 4.4 |
| Fibrillated T98 | N–.42 (F) H–.41 (F) | 4.4 |

The results indicated that the frictional properties and strength characteristics of the Kevlar pulp-based formulation were satisfactorily maintained when the fibrillated acrylic was used in place of the Kevlar pulp.

The method also works very well to fibrillate Kevlar staple, the similarly processed form of which is shown in FIG. 12.

Knowing now that fibrillation can be achieved by this method, it is straightforward and routine to test other fibers by this method to identify those which can similarly be fibrillated. Methods to determine adequacy of fibrillation include scanning electron microscope examination, and preforming.

Results to date establish that many other fibers do not respond satisfactorily to the present method. For example, FIG. 13 shows the results when nylon flock is treated; virtually no fibrillation is achieved.

The Osterizer is a small, domestic or bench scale size apparatus, and the rate of processing in it would be far too low for efficient commercial practice. However, it is contemplated that commercial production rates can be achieved by use of larger machines of similar design.

Having described the invention, what is claimed is:

1. A method of converting previously formed, unbranched but fibrillatable reinforcing fibers into a highly fibrillated, entangled fiber mass which is capable of reinforcing composite materials, said method comprising, suspending the fibers in an inert liquid, subjecting such suspension to the action of rapidly spinning sharp blades in a vessel, for sufficient time that the fibers become highly fibrillated, and separating the resulting fibrillated fibers from said liquid.

2. The method of claim 1 further wherein a turbulent flow is maintained of the suspension in the vessel, such that essentially all the fibers in the suspension pass repeatedly across said blades.

3. The method of claim 2 wherein the suspension is recirculated in a vortex across the paths of movement of the blades.

4. The method of claim 3 wherein the suspension is confined in a vessel which closely surrounds the tips of the blades, so that the fibers cannot escape the blades.

5. The method of claim 4 wherein the suspension is confined in a generally conical vessel while acted upon by the blades.

6. The method of claim 5 wherein the suspension is confined in a conical chamber with baffles which project inwardly and thereby increase turbulence.

7. The method of claim 6 wherein the blades are shaped as knife edges which are set at right angles, alternatively curving upward and downward.

8. The method of claim 7 wherein the path of the blade tips is an arc which clears the vessel wall by no more than 10% of the vessel radius.

9. The method of claim 8 wherein the suspension is recirculated by the blades with a tip speed of about 100 feet per second.

10. The method of claim 1 wherein the fibers are suspended in water while acted upon by the blades.

11. The method of claim 1 wherein said fibers are acrylic.

12. The method of claim 11 wherein said fibers are an acrylic staple fiber which is a copolymer of acrylonitrile and methyl methacrylate.

13. The method of claim 12 wherein said fibers have an entrained water content of about 50% by weight.

14. The method of claim 13 wherein said fibers have a denier of 4.0 or 5.4.

15. The method of claim 14 wherein said fibers are about 0.3% by weight of said suspension.

16. The method of claim 1 wherein said fibers are Kevlar staple fibers.

17. The method of claim 1 wherein said fibers are flax.

* * * * *